United States Patent [19]

Larque

[11] Patent Number: 4,715,759

[45] Date of Patent: Dec. 29, 1987

[54] COUNTERFOIL BINDING

[76] Inventor: Hubert Larque, Route de Lys, Bruges 64800 Nay, France

[21] Appl. No.: 682,752

[22] Filed: Dec. 17, 1984

[30] Foreign Application Priority Data

Dec. 23, 1983 [FR] France ..... 83 20800

[51] Int. Cl.[4] ..... B42F 1/00; B42D 1/10; B42D 5/00

[52] U.S. Cl. ..... 412/33; 281/23; 402/79; 412/8; 412/36; 412/901

[58] Field of Search ..... 412/8, 9, 33, 36, 37, 412/901; 402/79, 80, 501; 281/23; 156/247, 249, 537

[56] References Cited

U.S. PATENT DOCUMENTS

| | | | |
|---|---|---|---|
| 722,589 | 8/1902 | Kimsey | 281/23 |
| 755,002 | 11/1902 | Herrmann | 281/23 |
| 1,032,166 | 8/1911 | Trussell | 281/23 |
| 1,843,771 | 2/1932 | Kline | 402/79 X |
| 2,061,675 | 11/1936 | Schade | 402/79 |
| 3,014,580 | 12/1961 | Brody et al. | 402/79 |
| 3,620,891 | 11/1971 | Jones | 428/41 |
| 3,945,870 | 3/1976 | Johnsen . | |
| 4,422,672 | 12/1983 | Levi | 412/9 |

FOREIGN PATENT DOCUMENTS

| | | | |
|---|---|---|---|
| 2408108 | 8/1975 | Fed. Rep. of Germany | 402/79 |
| 3400244 | 7/1985 | Fed. Rep. of Germany | 402/79 |
| 0740536 | 1/1933 | France . | |
| 1581616 | 9/1969 | France . | |
| 2409862 | 7/1979 | France | 402/79 |
| 57-100173 | 6/1982 | Japan | 402/79 |
| 178995 | 5/1922 | United Kingdom | 281/23 |
| 1280156 | 7/1972 | United Kingdom | 402/79 |

*Primary Examiner*—Howard N. Goldberg
*Assistant Examiner*—Taylor J. Ross
*Attorney, Agent, or Firm*—Robert J. Koch

[57] ABSTRACT

This invention pertains to a system of counterfoil binding, fit in particular to classify documents in the form of loose sheets; it includes a number of thin superposed strips (2), which are bound together by any convenient means and covered, on either side, with an adhesive layer (1), characterized by the fact that the whole of the adhesive surface (1) is covered with a coating (3) in which is provided at least a line (4) of least resistance making it possible to partially remove the film (3*a*) as to substitute for it at least part of the loose sheet to be classified (7); in this way the sheet lies in the prolongation of the detached part (3*b*) of the film.

5 Claims, 6 Drawing Figures

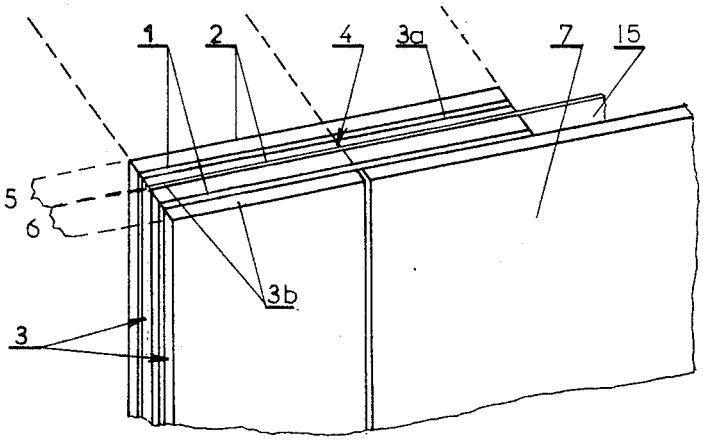
FIG. 1.
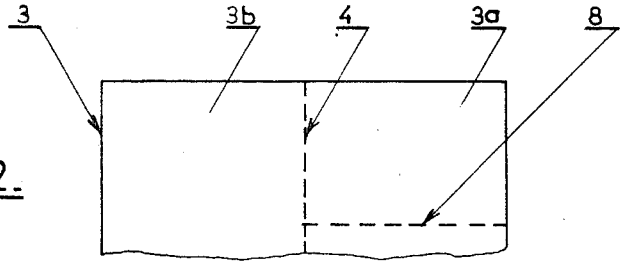
FIG. 2.
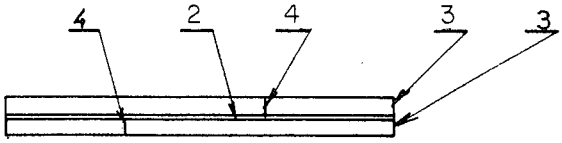
FIG. 3.
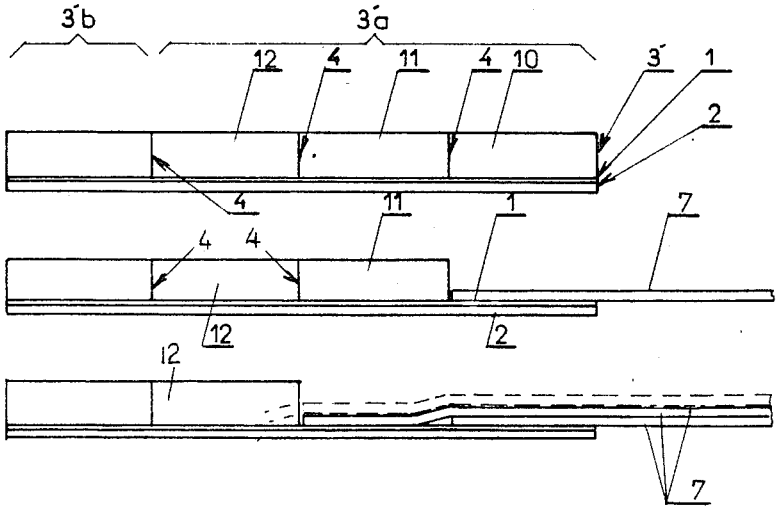
FIG. 4a.
FIG. 4b.
FIG. 4c.

COUNTERFOIL BINDING

BACKGROUND OF THE INVENTION

1. Field of the Invention

This invention pertains to a system of counterfoil binding to be used for assembling documents such as loose sheets which are to be classified or filed.

2. Description of the Related Art

Various devices making it possible to classify such documents are well known; among them: slide file, ring file, plastic wallet folder, files with fasteners and jaws; rod-, thread- or gummed back-bindings.

All these devices have, to different degrees, various drawbacks; they are cumbersome or not handy, require special tools, do not make it possible to add in extra sheets, etc.

In other devices, documents are glued on counterfoils fastened together in a rigid cover. So patent FR No. 1.581.616 describes a counterfoil device consisting of strips which are covered, on one of their sides, with adhesive material; each strip can be folded into two parts, one of which is provided with a protective strip which covers the adhesive. The strips are glued one on the other to form a counterfoil. The parts provided with a protective strip can receive a sheet, to be glued after the strip has been removed. This device has a serious drawback: when the whole is tightened in a rigid cover, owing to the strip being folded, the excessive thickness of the parts of the strips on which the sheets to be classified are glued only makes it possible to classify a small number of documents.

In patent FR No. 740,536 a number of counterfoils are provided, which are bound like a book, and on each of which a loose sheet can be fastened (for instance by a glueing process). This device, too, has the following serious disadvantage: as each sheet is glued on part of the surface of each counterfoil, this increases the thickness of the whole in the glueing area, proportionally to the number of glued sheets, which very substantially limits the capacity and advantage of this type of device.

SUMMARY OF THE INVENTION

What is proposed here is a device of the counterfoil and adhesive type which eliminates the drawbacks of the above-mentioned devices. It comprises a counterfoil binding system, fit in particular to classify documents in the form of loose sheets; it includes a number of thin superposed strips, which are bound together by any convenient means and covered, on either side, with an adhesive layer characterized by the fact that the whole of the adhesive surface is covered with a coating in which is provided at least a line of least resistance making it possible to partially remove the film so as to substitute for it at least part of the loose sheet to be classified; in this way, the sheet lies in the prolongation of the detached part of the film.

Thus the whole can be tightened flat without any excessive thickness, as the superposition of the strips which make up the counterfoils of this binding device remains constant in thickness, whatever the number of sheets glued together.

So the whole can be given a booklike or albumlike cover, whether removable or not. Several such sets can thus be superposed and bound by any appropriate means.

Other characteristics and advantages will appear from the following description of the different ways of realizing the device. This description is given only as an example, with reference to the attached diagram:

BRIEF DESCRIPTION OF THE DRAWINGS

FIG. 1 represents a partial perspective view of a counterfoil binding system corresponding to the invention.

FIG. 2 represents a partial view from above of a binding system corresponding to the invention.

FIG. 3 represents a cross-section of a counterfoil corresponding to the invention, with an alternative type of design.

FIG. 4*a* to 4*c* illustrate another variant of the design, allowing the fastening of several sheets on the same strip of binding.

DETAILED DESCRIPTION OF THE PREFERRED EMBODIMENT

The counterfoil binding corresponding to the invention, as illustrated in FIG. 1, includes a superposition of composite elementary strips consisting of an adhesive coating (1) applied on the whole of one of the faces of a strip (2), which can be rectangular and made of a flexible or rigid material (the latter can be either transparent or opaque), and which in turn is completely covered with another film (3) in an appropriate material, easily detachable from the adhesive in the usual way.

The film (3) is divided into two parts (3*a* and 3*b*) by a line of least resistance (4) parallel to the longitudinal edges of the strip and allowing the removal of one of the parts of the film and, more precisely, of part 3*a* located at the opposite of the back of the superposition of the counterfoil strips.

On FIG. 1 is shown a counterfoil strip (5) provided with its complete film (3*a*, 3*b*), and a counterfoil strip (6) of which part 3*a* of film 3 has been removed to be replaced by a loose sheet (7).

Several counterfoil strips like 5 and 6 are assembled together by superposition and fastened together by any appropriate means like glue, staples, or signature binding applied along the parts 3*b* of the counterfoil strips.

The thickness of the film (3) corresponds to the average thickness of a loose sheet in such a way that the total thickness of the superposition of the counterfoil strips like 5 or 6 is in no way altered by the addition of sheets (7).

The sizes of the counterfoil strips are variable. They can correspond or not to those of the covers and envelopes which may cover and enclose the counterfoil strips as a book does for exemple.

The detachable part (3*a*) can correspond to the size of the sheets to be glued (7).

The line of least resistance (4) may be completed (FIG. 2) by identical perpendicular lines (8) provided in part 3*a* so as to make it possible to glue several small-size documents on the same counterfoil strip, side by side and, consequently without any excess of thickness.

Line 4 is not necessarily in the middle of the counterfoil strip (FIG. 3) and the non detacbable part of it (2) may also have one or several lines of least resistance, so as to make it possible to reduce or modify at will the size of part 2.

In the alternative design illustrated by FIG. 4*a* to 4*c*, the film (3') covering the adhesive (1) is noticeably thicker than the documents to be glued (7) and its detachable part (3'*a*) is divided into three parts (10, 11, 12)

separately detachable. To this effect several parallel lines of least resistance (4) are provided, allowing the superposition on the same counterfoil strip of several documents (7) with a slight gap between them, as illustrated in FIG. 4*a* to 4*c*.

The increased thickness of the film (3') thus makes it possible to receive several superposed sheets (7), without any excess of thickness, which in turn makes it possible to add in sheets in classifying documents.

Preferably, adhesive 1 should allow any removal of the glued document and its replacement by another one.

It is to be noticed that counterfoil strips can be used individually instead of being fastened together and used as removable units of a classifying system, like, for example, the hook type, the counterfoil strips being, in that case, in the prolongation of the parts (3*b*), provided with holes.

Furthermore the counterfoil strips can be associated in files, parks or units which, in turn, can be fastened together in the same binding or assembling device, which makes the system very versatile.

According to still another variant, strip 2 of each counterfoil strip can be covered with an adhesive coating in its two faces and with a detachable film identical with film 3 also on its two faces, which makes it possible to glue two documents on the same counterfoil strip, in all cases without any excess of thickness of the latter as shown in FIG. 3.

Finally it is possible to add in between two superposed counterfoil strips a separating sheet 15, as in a photo album of indefinite size, possibly provided with a reference index in any place, exceeding the format of the file of the classified documents.

I claim:

1. A counterfoil binding for classifying documents in loose-leaf form, comprising:

a plurality of thin superimposed strips bound together at a lateral edge in pad-like form and covered on at least one entire side with an adhesive layer;

a removable film covering the entire adhesive layer, said film having at least one line of least resistance for facilitating partial removal of the film from the surface of said strip, said film having a thickness which is at least as great as the thickness of the documents to be classified and said at least one line of least resistance being parallel to the bound edge of said strip; and wherein each strip and associated film is configured so that removal of a portion of the film along said line of least resistance permits substitution of a loose-leaf sheet for the removed portion of film thereby forming a prolongation of the non-removed portion of the film and the non-removed portion maintains appropriate spacing between said plurality of strips.

2. The counterfoil binding of claim 1, wherein the film contains at least one additional line of least resistance arranged perpendicularly to the first said line of least resistance.

3. The counterfoil binding of claim 1, further including at least one additional line of least resistance in at least one film which permits removal of several portions of the film.

4. A counterfoil binding for classifying documents in loose-leaf form according to claim 1 wherein consecutive attached counterfoil strips are separated by a separating sheet.

5. The counterfoil binding of claim 1, wherein at least a portion of said thin strips are covered on each side with an adhesive layer with a removable film covering each said adhesive layer.

* * * * *